United States Patent [19]

Lazerand et al.

[11] 4,262,583

[45] Apr. 21, 1981

[54] METHOD FOR FIXING A HANDLE TO A PACKING

[75] Inventors: Jean Lazerand, Rochechouart; Andre Risbec, Neuilly-sur-Marne, both of France

[73] Assignee: Colgate-Palmolive Company, New York, N.Y.

[21] Appl. No.: 31,895

[22] Filed: Apr. 20, 1979

Related U.S. Application Data

[62] Division of Ser. No. 878,192, Feb. 16, 1978, Pat. No. 4,166,570.

[30] Foreign Application Priority Data

Feb. 22, 1977 [FR] France ..... 77 05114

[51] Int. Cl.[3] ..... B31B 1/86

[52] U.S. Cl. ..... 493/444; 493/36; 493/88; 493/909

[58] Field of Search ..... 93/36.7, 36 M, 35 H, 93/8 WA; 229/52 AL, 52 B; 53/134

[56] References Cited

U.S. PATENT DOCUMENTS

| | | | |
|---|---|---|---|
| 2,851,211 | 9/1958 | Bergstein | 229/52 AL |
| 2,986,324 | 5/1961 | Anderson, Jr. | 229/52 B |
| 3,548,723 | 12/1970 | Sengewald | 93/35 H |
| 3,773,591 | 11/1973 | Blair | 93/35 H X |
| 3,808,957 | 5/1974 | Hosoya et al. | 53/134 X |
| 4,027,578 | 6/1977 | Varga et al. | 53/134 X |

*Primary Examiner*—James F. Coan

*Attorney, Agent, or Firm*—Herbert S. Sylvester; Murray M. Grill; John A. Stemwedel

[57] ABSTRACT

Method for fixing a handle to a package. The closing flap of a package is provided with the ears is attached, which strip rises to form a handle when the foldable ears bearing the strip are folded towards the strip.

5 Claims, 7 Drawing Figures

METHOD FOR FIXING A HANDLE TO A PACKING

This is a division of application Ser. No. 878,192 filed Feb. 16, 1978 now U.S. Pat. No. 4,166,570.

The present invention relates in a general way to packings which are on the whole parallel-sided and constructed from a blank of cardboard, corrugated cardboard or other sheet material which is suitably cut out and grooved, and more particularly relates to the case where such packings must be equipped with a handle for facilitating the taking hold of and the handling of the packings.

In the known manner, the blank from which such a packing is made usually comprises four generally quadrangular side panels which are in alignment and successively articulated in pairs by parallel transverse fold lines, the two end side panels of this alignment of panels being, if desired, fastened to each other to constitute a preliminary tubular packing unit which may be delivered in a flat condition and may be very rapidly and easily put into its final shape defining a volume at its place of use.

As is also known, the side panels of such a blank are usually extended laterally, along the same longitudinal side of the alignment that they form and beyond root or longitudinal fold lines perpendicular to the transverse fold lines between the side panels, by bottom flaps capable of together forming a bottom by a folding at a right angle and a more or less accentuated relative superimposition, for example in the manner of bottoms usually called "American bottoms".

The present invention concerns more particularly the case where along the other longitudinal side of the alignment of side panels of such a blank, at least some of these side panels are extended, also laterally beyond the root or longitudinal fold line perpendicular to the transverse fold lines between pairs of the side panels, by closing flaps capable of forming together an end closure which may or may not be similar to the associated bottom.

In order that the packing which comes from such a blank be equipped with a handle, it has already been proposed to attach such a handle on two side panels of the corresponding preliminary tubular packing unit by means of rivets for example.

But the mounting of this handle requires, subsequent to the construction of a preliminary tubular packing unit, a further operation on the unit in the course of which this unit is opened and there is introduced therein a support member capable of taking the thrust of the tool necessary for placing the rivets on two of these opposite side panels, the unit being thereafter closed.

It is therefore necessary to provide, in addition to the usual machines employed for cutting out, grooving and folding shaped blanks, a machine capable of effecting the further operation leading to the mounting of a handle.

For mounting such a handle on a preliminary tubular packing unit, it has also been proposed to attach such a handle individually on a support, independently of the cutting out, grooving and folding operations which lead to the formation of this preliminary tubular packing unit, then attaching to this unit the support which is thus provided with a handle.

But, apart from the fact that, in this case, it is thus necessary to provide a special operation for the individual construction of the handles to be mounted, it is also necessary, as before, to mount these handles, in the course of a further operation carried out for this purpose on the preliminary packing units to be equipped with such a handle.

An object of the present invention is to avoid such a further operation.

More precisely, it has mainly for object to provide a method suitable for fixing a handle to a packing without effecting any further operation on the blank and/or to the preliminary tubular unit employed in the formation of such a packing.

It also has for object to provide a blank, a preliminary unit, and a packing treated in accordance with this method.

According to the invention, there is provided a method for fixing a handle to a packing having at least one closing flap, comprising providing, on two opposite edges of said flap, ears disposed in the extension of each other, each of which ears is located beyond a fold line, attaching a strip in the flat condition to said flap and to said ears, rendering said strip integral with said ears, for example by adhesive, folding said ears over against said flap about their respective fold lines and onto the side of said flap on which side said strip is provided, and fastening said folded-over ears to said flap, for example by adhesion.

It has indeed been found that a strip, thus placed in position in the flat condition and extending from one of the ears of the flap that it equips to the other, shapes itself, when folding the ears in question over against said blank, into a handle which projects from said flap owing to the fact that, as a result of this folding over, the ends of the free median part of the strip, that is to say the ends of its unfixed body part, move toward each other.

But the fact that, notwithstanding the projecting handle which it subsequently forms, this strip can, according to the invention, be placed in the flat condition, permits easily integrating the corresponding mounting operation in the procedure which leads, in the usual manner, to the formation of blanks in the treated material, even before the cutting out of such a blank from this material.

Moreover, the folding over of the ears to which the strip is secured can be easily integrated into the treating procedure applied to a cut-out blank for forming a preliminary tubular packing unit, since this folding over implies a simple folding of the type usually met with in the course of such a procedure.

Thus there is no retouching or further operation to be applied to the preliminary tubular packing unit obtained, and there is a marked reduction in the overall cost of manufacturing the packings.

Furthermore, as a result of the method according to the invention, the ends of a strip forming a handle are firmly trapped and gripped between, on one hand, the closing flap provided with this strip forming a handle and, on the other hand, ears which form a continuous lateral extension of this flap and are folded over onto the flap.

Consequently, the strip forming a handle according to the invention advantageously has high tensile strength.

The objects of the invention and the features and advantages thereof will be apparent from the ensuing description which is given solely by way of example with reference to the accompanying diagrammatic drawings in which.

Figure 1:
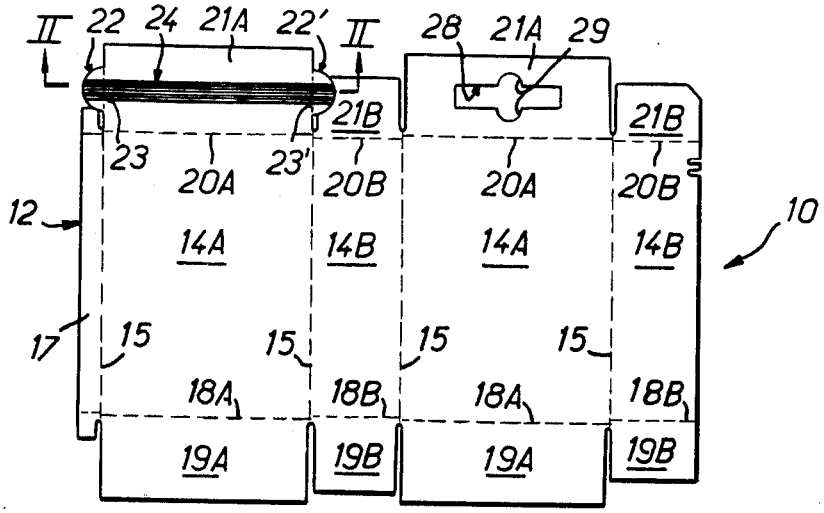
FIG. 1 is a plan view of a blank according to the invention.
Figure 2:
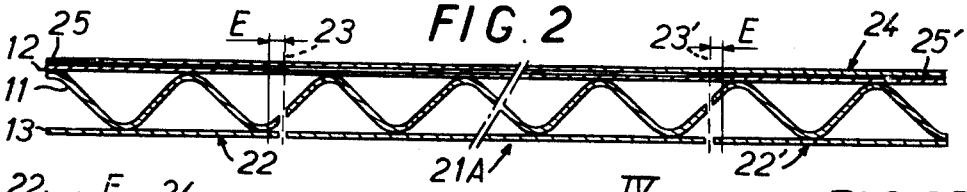
FIG. 2 is a partial sectional view of this blank taken on line II—II of FIG. 1 and to an enlarged scale.

These Figures illustrate by way of example the application of the invention to the case where the blank 10 suitable for producing a packing according to the invention is cut out from a sheet of double-sided corrugated cardboard, that is to say a sheet of corrugated cardboard having, as can be seen better in FIG. 2, a median corrugated layer 11 disposed between an outer closing side 12 and an inner closing side 13 and suitably rendered integral with one another in practice by adhesion of the crest lines of the corrugations to said closing sides.

In a conventional manner, the cutting lines pertaining to this blank are represented in full lines whereas the fold lines are represented in dashed lines when they correspond to a first direction of folding toward the inner closing side 13, and in dotted lines when they correspond to a second direction of folding opposed to the foregoing folding and therefore directed toward the outer closing side 12.

As it concerns the construction of a generally parallel-sided packing, the blank 10 comprises in a general manner a longitudinal alignment of four generally quadrangular side panels 14A, 14B which are successively articulated in pairs by transverse parallel fold lines 15.

As it more precisely concerns, in the illustrated embodiment, the construction of a parallel-sided packing of rectangular cros-section, the blank 10 comprises two side panels of larger width 14A which alternate with two side panels of smaller width 14B.

To construct a preliminary tubular packing unit with such a blank 10, means are provided for fastening the end side panels of the packing to each other.

In the illustrated embodiment, the blank 10 has for this purpose, beyond a transverse fold line defining the end transverse edge of a side panel 14A, a connecting band 17 which is capable of being applied against the side panel 14B which is opposed thereto and of being suitably fastened to the latter, for example by adhesion.

Along a given longitudinal side of the alignment of side panels 14A, 14B and beyond the root or longitudinal fold lines 18A, 18B perpendicular to the transverse fold line 15, the blank 10 comprises laterally bottom flaps 19A, 19B which are individually and wholly disposed in the extension of their corresponding side panels 14A, 14B and are capable, in the known manner, of forming together a bottom of the type commonly termed "American bottom".

Along the opposite longitudinal side of the alignment of side panels 14A, 14B and beyond the root or longitudinal fold lines 28A, 28B perpendicular to the transverse fold lines 15, the blank 10 also comprises laterally closing flaps 21A, 21B which are individually and wholly disposed in the extension of the corresponding side panels 14A, 14B and are capable of forming together and end closure similar, in the illustrated example, to the associated bottom, the closing flaps 21A, 21B being essentially respectively similar to the corresponding bottom flaps 14A, 14B.

These arrangements are well known in themselves and will not be described in more detail here.

According to the invention, the closing flap 21A of the blank 10 is provided laterally, on two opposite edges, with ears 22, 22' which are disposed in alignment with each other and are located beyond a fold line 23, 23' which is substantially perpendicular to the root or longitudinal fold line 20A of this closing flap 21A and is substantially in the extension of the corresponding transverse fold line 15 of the side panel 14A which extends this closing flap 21A.

The fold lines 23, 23' defining the ears 22, 22' correspond to a fold directed toward the outer closure side 12.

In the known manner, these fold lines 23, 23' may be embodied, for example and as shown, by a sectioning of the inner closing side 13 of the corrugated layer 11 achieved by a suitable grooving of the blank 10 (FIG. 2).

Placed on the outer closing side 12, a strip 24 extends in the flat condition along the closing flap 21A, from one of the ears 22, 22' of the latter to the other.

The ends of the strip 24 are rendered integral with the ears 22, 22', for example by adhesion.

In FIG. 2, the corresponding zone of interconnection 25, 25' has been diagrammatically represented in thick lines.

Preferably, in respect of each ear 22, 22', this interconnecting zone 25, 25' does not go beyond the fold line 23, 23' separating the ear from the closing flap 21A that it extends.

In the illustrated embodiment (FIG. 2), there has been diagrammatically shown at E the corresponding distance between the limit of an interconnecting zone 25, 25' and the corresponding fold line 23, 23'.

A strip 24 according to the invention may be placed in the flat condition at any stage of the procedure for producing a blank 10.

For example, it is possible to place in a continuous manner such strips in the form of a band on the material from which the blank 10 is cut out, even during the forming of this material or subsequent to the forming thereof, this band being fastened at intervals to said material in regions corresponding to the blanks which are thereafter cut out from the material.

By way of a modification, the strips 24 in question may be fastened, in different places and discontinuously, to the material in question in regions corresponding to the flaps which are thereafter cut out from the material, these strips being for example placed in position at a mounting station in synchronism with the blank cutting station.

The strip 24 according to the invention is preferably placed in position on the material from which the blank 10 is made even before this blank is cut out from this material.

Moreover, the second closing flap 21A of the blank 10 which is intended to be opposed to that which, as described hereinbefore carries a strip 24, has a slot 28 suitable for the passage of this strip, as described hereunder, and the edges of this slot 28 are each provided with a notch 29 which face each other.

Figure 3A:
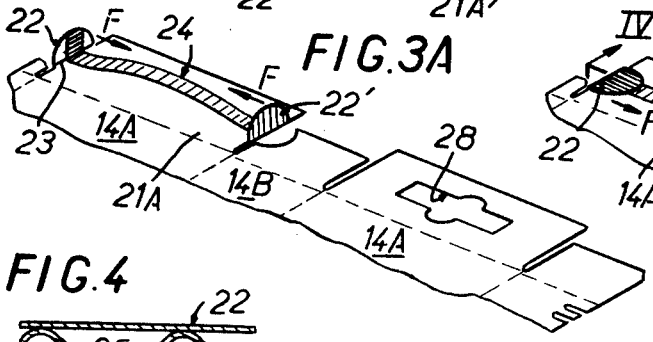
FIGS. 3A and 3B are partial perspective views thereof illustrating the folding operations producing the required handle.
Figure 3B:
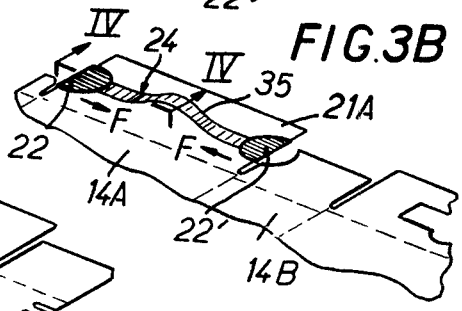

The ears 22, 22' carrying the strip 24 are according to the invention folded over against the flap 21A that they extend, by folding at 180° about their respective fold lines 23, 23' on the side of said flap 21A on which said strip 24 is located (FIG. 3A) and then rendered integral with the flap 21A in question, for example by adhesion (FIG. 3B).

This folding over operation may be carried out even during the procedure for converting the blank 10 into a preliminary tubular packing unit by the connection of the tongue 17 extending the end side panel 14A to the end side panel 14B before or after this procedure.

Figure 4:
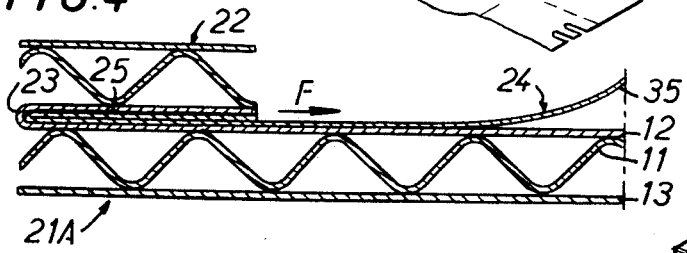
FIG. 4 is a partial sectional view, similar to FIG. 2, after the folding-over operations in question.

However this may be, in the course of such a folding over, the ends of the free median part of the strip 24 are offset toward each other so that the strip, as diagrammatically represented in FIGS. 3A, 3B and 4, is deformed and constitutes a handle 35 which projects from the flap 21a on which it is mounted.

This offsetting, diagrammatically represented by the arrows F in FIGS. 3A, 3B and 4, increases (and the same is true in respect of the projection of the handle formed by the strip 24) with increase in the difference E explained hereinbefore between the fixed ends of this strip and the corresponding fold lines. But in practice, this offsetting occurs even if this distance E is zero.

Figure 5:
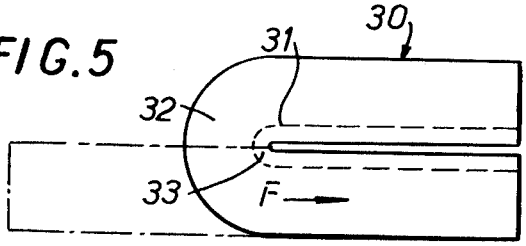
FIG. 5 is a diagrammatic view illustrating in a general manner the conditions under which the folding of a material is effected in the course of such a folding over.

The offsetting in this case may be explained by the fact that as is diagrammatically represented in FIG. 5, there is in the course of the folding of any material 30 onto itself, a neutral fibre 31 of this material which is subjected to neither tensile stress nor compressive stress and divides the thickness of this material into two layers, namely a lower layer 32 subjected to tensile stress and an upper layer 33 subjected to compressive stress.

The parts of the layer 33 which are located to the left of the fold line corresponding to the folding over of the material 30 onto itself, are upon this folding over offset toward the right in the direction of arrow F of FIG. 5, and the same is true of any elements carried on the surface of this material to the left of this fold. This is true of the parts of the strip 24 which remain unconnected to the ears 22, 22' extending the closing flap 21A carrying the strip 24.

It will be noted that, after the folding over of these ears 22, 22', the corresponding end of the strip 24 is firmly enclosed and gripped between these ears and the corresponding closing flap 21A and the resulting fastening is all the more definite that the ears 22, 22' form a continuous extension of this flap.

Figure 6:
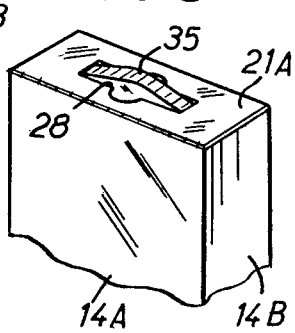
FIG. 6 is a partial perspective view of the upper part of the parallel-sided packing obtained from a blank according to the invention.

In the course of the opening or putting into a volume of the preliminary tubular packing unit made from a blank 10 according to the method described hereinbefore, the flap 21A carrying the handle 35 formed by the strip 24 according to the invention is folded at a right angle before folding the closing flap 21A having a slot 28 and said handle 35 is engaged in said slot (FIG. 6).

This handle 35 is thus accessible to any user from the exterior and the taking hold of the handle 35 is facilitated by the notches 29 of the slot 28 through which it is passed.

As the construction of the preliminary tubular packing unit from the blank 10 and the putting into a volume of this preliminary tubular packing unit are effected in the usual manner, these operations will not be described in detail here and it is unnecessary to describe in more detail or to represent such a preliminary tubular packing unit which, as is known, can be advantageously delivered in the flat condition.

Preferably, but not obligatorily, the strip 24 to be used according to the invention is a simple strip or belt of synthetic non-woven material, for example, of polyethylene. Such an arrangement, which must not be considered as limitative of the invention, gives particular satisfaction.

It must be understood that this invention is not limited to the embodiment described and shown but encompasses all modifications thereof within the scope of the invention.

We claim:

1. Method for fixing a handle to a packing comprising at least one closing flap which handle projects from said closing flap; said method comprising providing on two opposed edges of said one flap ears which are located in the extension of each other, each beyond a fold line, mounting a strip in the flat condition on said flap and said ears, fastening said strip to said ears, folding said ears about their respective fold lines over onto a side of said flap on which side said strip is located, and fastening said folded-over ears to said flap.

2. A method as claimed in claim 1, wherein the zone in which the strip is fastened to an ear is limited to within the fold line between said ear and the flap that said ear extends.

3. A method according to claim 1 or 2, the packing concerned coming from a blank of cardboard, corrugated cardboard or other sheet material which is suitably cut out, comprising continuously fastening strips to said material in the form of a band, said band being fastened at intervals to said material in correspondence with the blanks which must be thereafter cut from said material.

4. A method as claimed in claim 1 or 2, the packing concerned coming from a blank of cardboard, corrugated cardboard or other sheet material suitably cut out, comprising fastening strips to said material at intervals in correspondence with the blanks which must be thereafter cut from said material.

5. A method as claimed in claim 4, wherein the strips are fastened to the concerned material at an assembling station which is synchronized with a cutting station at which the blanks are cut from said material.

* * * * *